United States Patent [19]

Douchy

[11] Patent Number: 4,956,010

[45] Date of Patent: Sep. 11, 1990

[54] METHOD OF DESULPHURIZING PIG-IRON

[75] Inventor: Michel Douchy, Solesmes, France

[73] Assignee: Affival, France

[21] Appl. No.: 336,860

[22] Filed: Apr. 12, 1989

[30] Foreign Application Priority Data

Apr. 14, 1987 [FR] France ..... 88 04927

[51] Int. Cl.[5] ..... C21C 7/02

[52] U.S. Cl. ..... 75/304; 75/526

[58] Field of Search ..... 75/53, 58

[56] References Cited

U.S. PATENT DOCUMENTS

| | | | |
|---|---|---|---|
| 1,588,761 | 6/1926 | Ligot | 219/46.55 |
| 1,629,748 | 5/1927 | Stoody | 75/53 |
| 2,576,698 | 1/1951 | Russum | 154/28 |
| 2,892,007 | 6/1959 | Rickards | 174/102 R |
| 3,474,518 | 10/1969 | Strandell | 29/429 |
| 3,915,693 | 10/1975 | Rasmussen | 75/53 |
| 3,998,625 | 12/1976 | Koros | 75/58 |
| 4,126,446 | 11/1978 | Knorre | 75/53 |
| 4,134,196 | 1/1979 | Yamaji | 29/420 |
| 4,137,446 | 1/1979 | Blanpain | 219/145 |
| 4,174,962 | 11/1979 | Frantzreb | 75/53 |
| 4,209,325 | 6/1980 | Cooper | 75/58 |
| 4,217,133 | 8/1980 | Goto | 75/58 |
| 4,220,031 | 9/1980 | Nashind | 72/379 |
| 4,364,770 | 12/1982 | Douchy | 75/53 |
| 4,364,771 | 12/1982 | Cordier | 75/58 |
| 4,486,227 | 12/1984 | Douchy | 75/53 |
| 4,786,322 | 11/1988 | Green | 75/58 |
| 4,863,803 | 9/1989 | Douchy | 420/552 |

FOREIGN PATENT DOCUMENTS

| | | |
|---|---|---|
| 4780620 | 4/1974 | Japan . |
| 49124281 | 4/1976 | Japan . |
| 48138324 | 6/1976 | Japan . |

*Primary Examiner*—Peter D. Rosenberg

*Attorney, Agent, or Firm*—Jones, Day, Reavis & Pogue

[57] ABSTRACT

The method concerns the desulphurization of cast iron produced by a blast furnace, before it is converted to steel.

In a first phase of the process the cast iron is treated with a desulphurizing compound such as $Na_2CO_3$. A very long composite product with a tubular skin is then added to the cast iron. The product comprises an axial zone containing magnesium in powdered or granular form, and an annular zone, separated from the axial zone by an intermediate wall and containing a powdered or granular material. An inert gas could then be injected and a clearing operation carried out.

18 Claims, 1 Drawing Sheet

METHOD OF DESULPHURIZING PIG-IRON

Figure 1:
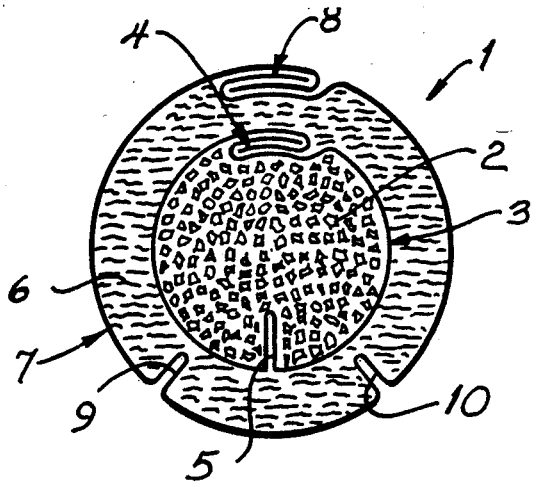

The method of the invention concerns the desulphurisation of pig-iron, and more particularly, pig-iron produced in a blast furnace for conversion to steel.

The commonest methods of desulphurising pig-iron from a blast furnace use compounds which make it possible either to form a slag which can fix the sulphur contained in the pig-iron, or to fix the sulphur directly by forming a compound which then separates from the pig-iron. Thus $Na_2CO_3$ is added to liquid pig-iron, creating a slag which can fix large quantities of sulphur. CaO and/or $CaCO_3$ and/or $CaC_2$ are also added; these directly or indirectly form Ca S, which is insoluble in the pig-iron and which separates from it through the difference in density.

Experience shows that the action is relatively slow when such compounds are added, and that it is not easy to obtain a very low sulphur content. This is particularly so with very large ladles containing about 200 tonnes or more of pig-iron, where it is difficult to provide sufficiently effective agitation.

A first method of desulphurisation in a ladle is described by M. BRAMMING and C. G. NILSSON (Revue de Metallurgie CIT June 1987 pages 487–497).

Instead of using $Na_2CO_3$ which is not sufficiently effective, the method comprises using a desulphurising mix containing (by mass) 85% of a two part mix, consisting of 75% of $CaC_2$ and 25% of $CaCO_3$, and 15% of granular Mg.

Tests have shown that if 2.9 Kg of this desulphurising mix is used per tonne of liquid pig-iron, the iron can be desulphurised effectively even at relatively low temperatures of about 1250° C.

The sulphur content is thus lowered from an initial level of 60 thousandths of 1% by mass to a final level of about 15 thousandths of 1%. The desulphurising mix is injected into the ladle of liquid pig-iron by means of a blast pipe, which introduces the desulphurising mix fluidised by nitrogen, deep in the liquid pig-iron.

A second method is described by R. PIEPENBROCK and P. SCHITTLY (Fachberichte Hüttenpraxis Metallweiterverarbeitung Vol. 23 No. 8-1985 pages 594–598). It is applied to the treatment of pig-iron from a blast furnace, containing 14 to 60 thousandths of 1% of sulphur by mass.

According to this document a first desulphurising treatment is carried out by adding 1 to 1.5 Kg of $Na_2CO_3$ per tonne of pig-iron to the ladle, which receives about 200 tonnes of liquid pig-iron from the blast furnace. The desulphurising action of the $Na_2CO_3$ takes place during transfer from the ladle to the steelworks, where a filled wire is introduced into the liquid pig-iron at a second stage. The filled wire, with an outside diameter of 9 mm, has a steel skin 0.4 mm thick and contains a mix made up of 78% of Mg and 22% of $CaC_2$.

From 0.15 to 0.49 Kg of Mg per tonne of liquid pig-iron is added at a rate of about 8.75 Kg per minute, corresponding to 175 m of filled wire per minute.

The results obtained are encouraging, with a final sulphur content as low as 3 to 10 thousandths of 1% by mass: however, the following features are observed:

the results vary quite widely there is a very strong reaction from the bath treated, with spitting of liquid metal, which means that the wire has to be guided very close to the bath. Consequently the wire guides are found to deteriorate rapidly.

there is poor control of the addition of magnesium at the bottom of the ladle, which explains the erratic performance of magnesium as a desulphurising agent.

Research has been carried out into the possibility of developing a desulphurising process, whereby pig-iron from a blast furnace can be thoroughly desulphurised by a rapid and reproducible process, e.g. to a sulphur content of no more than 12 thousandths of 1%, preferably 10 thousandths of 1%, given an initial content of up to 100 thousandths of 1%.

Research has also been carried out on the possibility of evolving a process which is easy and quick to use, and which does not entail any appreciable danger of violent, uncontrolled liberation of gas or excessive reactivity of some components when brought into contact with one another.

Another requirement was that it should be unnecessary to use a fluidifying gas to inject magnesium based metallic reagents into the liquid pig-iron, since these cause spitting and losses.

The single FIGURE is a cross-sectional view of the preferred composite employed in the invention as described and claimed herein.

The method of the invention enables these results to be obtained. In particular it makes it possible to start with an initial sulphur content as defined above, relatively high and sometimes ill-defined, and to achieve a final well controlled content of 12 thousandths of 1% or less, by a reproducible method and without the need for frequent analytical checks at every stage of the process.

The process comprises a first phase, during which the liquid pig-iron emanating directly or indirectly from a blast furnace is filled into a ladle, in which it is put into contact with at least one oxide, carbonate or carbide of a metal of the group comprising Na, K, Mg and Ca.

It is preferable to select at least one of the following compounds: $Na_2CO_3$, $CaCO_3$, $CaC_2$, Cao or MgO.

Repeated contact between the liquid pig-iron and the compound or compounds selected within the ladle can be encouraged by using known means, such as simultaneous introduction of the compound or compounds and the pig-iron, or direct injection into the liquid iron through a blast pipe, in the case of compounds such as $CaC_2$, CaO or MgO, $Na_2CO_3$, $CaCO_3$ etc, or any other means known in the art.

It is particularly advantageous to use $Na_2CO_3$, which forms a slag capable of fixing large quantities of sulphur.

The quantity of $Na_2CO_3$ or at least one other compound is preferably selected within the range from about 1 to 12 Kg and preferably 1 to 8 Kg per tonne of liquid pig-iron.

In a second phase a composite product of great length with a very long tubular skin, also known as a filled wire, is fed into the liquid pig-iron at a temperature of about 1150° to 1400° C. The composite product comprises an axial zone, chiefly containing a metallic, powdered or granular, preferably compacted material containing at least 40% by mass of Mg in alloyed or unalloyed form; the axial zone being surrounded by an intermediate metallic tubular wall; and an annular zone between the intermediate wall and the outer metallic skin, containing at least a second powdered or granular, preferably compacted material.

The powdered or granular material contained in the annular zone preferably comprises at least one compound from the group which can be used in the first phase of the process. $CaC_2$, CaO or MgO may advantageously be employed for this purpose. A compound with insulating properties may equally be provided, such as grains of a refractory compound with low thermal conductivity. The quantity of Mg introduced per tonne of liquid pig-iron depends on the initial sulphur content of the iron to be treated and is from about 0.1 to 1 Kg. The quantity of compound in the annular zone is preferably from 0.1 to 2 Kg per tonne of pig-iron.

In the third phase of the process decantation of the sulphur is preferably encouraged, most of the sulphur having been fixed in the form of solid particles of magnesium sulphide. For this purpose a gas such as nitrogen or argon is injected through the liquid pig-iron, by means of a blast pipe submerged to near the bottom of the ladle, or through a porous plug located near the bottom of the ladle. The time taken to inject the gas will preferably not be more than about 12 minutes; it is generally restricted to a period of 2 to 10 minutes and preferably 2 to 4 minutes.

A fourth phase of the process advantageously comprises a clearing operation to eliminate the slag which is rich in sulphur, thus avoiding the risk of resulphurising the pig-iron.

The outer skin of the composite product may preferably be made of a metal or alloy with a melting point not substantially above that of the liquid pig-iron. An alloyed or unalloyed aluminium may in particular be used. The intermediate tubular wall may be a metal or alloy with a melting point not above that of the metal or alloy of the outer skin.

At least the outer skin may be closed by any means which will not impair the quality of the materials contained in it, for example by a folded seam connection. The intermediate wall may be closed simply by drawing it together or overlapping it, or again with a folded seam connection or by any other means which will not impair the quality of the material contained in the axial zone.

The powdered or granular material contained in both the axial and the annular zone may be compacted by any suitable means, such as compression, drawing or other methods. It is particularly advantageous to follow the teaching of Patent Application FR No. 86 03295 filed Feb. 24, 1986 and published under No. 2 594 850.

The teaching can be applied by closing at least one of the two walls, the intermediate wall or the outer skin containing the powdered or granular material, and deforming it in a concave shape to form at least one open pleat. The pleat is then closed by inwardly directed pressure, to reduce the diameter of the skin without appreciably changing its perimeter or appreciably elongating it lengthwise. It is particularly advantageous first to compact the axial zone by the method just described, when the intermediate wall has been closed, e.g. with a folded seam connection. The filling material for the annular zone can then be put into position around the intermediate wall, and the wall can be closed, e.g. by joining the outer skin with a folded seam connection. The final compacting can then be carried out by the same method.

The invention also concerns a composite product of great length with a very long tubular metallic skin, which enables alloyed or unalloyed magnesium to be added to the liquid iron in order desulphurise it. This product is particularly effective in carrying out the method of the invention.

It comprises an axial zone surrounded by an intermediate metallic tubular wall of substantially circular section. This at least mainly contains a first powdered or granular, compacted material with a magnesium content, in alloyed or unalloyed form, of at least 40% by mass. The composite product further comprises an annular zone between the intermediate wall and an outer metallic tubular skin of substantially circular section. The annular zone contains a second powdered or granular, compacted material. According to the invention at least the intermediate metallic tubular wall or the outer metallic tubular skin is closed by a closing means and contains at least one pleat which is shut in on itself.

The tip of the closed pleat is inside the compacted material, and the edges of the pleat join the peripheral zone of the intermediate wall or outer skin.

The non-restrictive example given below and the one drawing illustrate an embodiment of the method of the invention for desulphurising pig-iron. About 200 tonnes of liquid pig-iron is cast from a blast furnace, a submarine ladle or a mixer into a transfer ladle with 1.5 tonnes of $Na_2CO_3$ at the bottom of it.

The ladle is then transferred to the magnesium treatment stand.

At this stage the average temperature of the cast iron is 1250° C.

A very long composite product is then unwound from a reel or cage and introduced vertically downwards into the liquid pig-iron by known means. A section through the composite product is shown in the accompanying drawing.

The composite produce 1 comprises an axial zone 2 containing compacted granular magnesium; the grains may e.g. be about 1 mm in size. The intermediate tubular wall 3, made of unalloyed aluminium, is about 0.4 mm thick with an outside diameter of about 9 mm. The wall 3 is joined by a folded seam at 4 and has a closed pleat 5 formed along a generatrix. The pleat enables the magnesium grains to be compacted, following the teaching of above-mentioned Patent Application FR No. 86 03295. The annular zone 6 contains powdered $CaC_2$.

The outer skin 7 is joined by a folded seam at 8 also made of unalloyed aluminium about 0.4 mm thick, with an outside diameter of about 13 mm. The $CaC_2$ powder is compacted by means of the two closed pleats 9, 10. These have been closed by inwardly directed pressure, as in the case of the intermediate skin 3, without any appreciable elongation of the skin lengthwise or any appreciable change in its perimeter.

In an alternative embodiment only one closed pleat may be used for compacting the powder in the annular zone, instead of two. The axial zone contains 54 g of Mg per meter of its length, and the annular zone 90 g of $CaC_2$. The composite product is added to the pig-iron at a speed of 300 m per minute.

Under these conditions the magnesium is put into contact with the liquid pig-iron substantially along the vertical axis from the point where it enters the pig-iron to a depth of about 2.5 to 3 m.

The total quantity to be added is 0.4 Kg of Mg per tonne of liquid pig-iron, i.e. 80 Kg of Mg. Hence altogether 1480 m of composite product is added. The corresponding quantity of $CaC_2$ added is 133 Kg. The time taken to add it is slightly less than 5 minutes.

Argon or nitrogen is then injected through a porous plug fitted at the bottom of the ladle or through a submerged blast pipe, so as to encourage decantation of the magnesium sulphide and calcium sulphide formed. The injection time is about 4 minutes with a flow rate of 500 to 600 liters per minute. The desulphurisation treatment is completed with a clearing operation, which eliminates the slag enriched with sulphur so as to avoid subsequent resulphurisation.

Analyses carried out give the following results.

| | Sulfur content in thousandths of 1% by mass |
|---|---|
| Initial S content of cast iron | 90 (i.e. 0.090%) |
| S content of pig-iron after addition of $Na_2CO_3$ | 34 (i.e. 0.034%) |
| S content of pig-iron after addition of Mg | 11 (i.e. 0.011%) |
| S content of pig-iron after addition of nitrogen | 7 (i.e. 0.007%) |

The process can be seen to eliminate about 90% of the sulphur originally present, and to reduce the sulphur content to less than 10 thousandths of 1%, given a starting level of 90 thousandths of 1%.

Many tests have shown how readily the process can be reproduced. This is largely due to the use of a composite product with two walls, which can descend deep into the liquid pig-iron. The fact that each wall is made of a metal with a melting point below the temperature of the liquid pig-iron further enables the magnesium to be liberated completely, deep down within the bath in a very short time, as soon as the melting temperature of the intermediate wall is reached.

Thus if the initial sulphur content ranges from 40 to 110 thousandths of 1% and the quantities of magnesium added range from 0.1 to 0.6 Kg per tonne of liquid pig-iron, according to the initial sulphur content, and if phases 1 and 2 of the process described are applied to cast iron emanating directly or indirectly from a blast furnace, then the degree of desulphurisation obtained will be from 60 to 90% of the initial sulphur with an average of 77%.

After a complementary phase in which inert (neutre) gas is injected, the degree of desulphurisation obtained reaches 82 to 93% of the initial sulphur with an average of 87%.

Comparative tests have been carried out, using a composite product (or filled wire) with a single, steel skin for the second phase of the process, the skin containing a mixture of Mg and $CaC_2$ in the same proportions as in the above test. These showed a much lower average desulphurisation rate (13%) and a great spread of results, from 60 to 83% as against 82 to 93% in the method of the invention. When aluminium was used for the single skin instead of steel the results became still worse, since the magnesium did not reach any depth in the iron and did not produce adequate desulphurisation.

It will be noted that the $CaC_2$ powder in the annular zone, in the case shown in the figure, acts both as a desulphurising agent and a heat insulator. Some or all of the $CaC_2$ may be replaced by a different desulphurising compound or by a heat insulator such as slag granules. In this case it may be helpful slightly to increase the quantity of magnesium used.

What is claimed:

1. A method of desulphurizing liquid pig-iron comprising the steps of:

contacting the liquid pig-iron with a metal selected from the group consisting of Na, K, Mg, Ca and mixtures thereof, in a form selected from the group consisting of oxide, carbonate, carbide and mixtures thereof; and introducing a filled wire in the liquid pig-iron, the wire having an axial zone surrounded by an intermediate tubular metallic wall, the axial zone containing metallic magnesium in a form selected from the group consisting of alloyed metallic magnesium, unalloyed metallic magnesium, and mixtures thereof, the magnesium in alloyed or unalloyed form comprising at least 40% of the mass of the material in the axial zone, the wire also containing a annular zone between the intermediate wall and an outer tubular metallic skin, the annular zone containing a second material.

2. The method of claim 1 wherein the cross-section of the intermediate metallic wall is substantially circular and the cross-section of the outer metallic skin is substantially circular.

3. The method of claim 1 or claim 2 wherein the intermediate wall and outer skin are made of a material having a melting temperature below the temperature of the liquid pig-iron.

4. The method of claim 1 wherein when the wire is introduced into the liquid pig-iron, the temperature of the pig-iron is between 1150° and 1400° C.

5. The method of claim 3 wherein the intermediate wall and outer skin are made of a material selected from the group consisting of alloyed aluminum and unalloyed aluminum.

6. The method of claim 1 wherein the step of introducing the filled wire introduces between 0.1 and 1 kilogram of magnesium in the alloyed or unalloyed state per ton of the pig-iron.

7. The method of claim 1 wherein the step of contacting the metallurgical bath introduces between 1 and 12 kilograms of $Na_2CO_3$ per ton of pig-iron.

8. The method of claim 1 wherein the annular space of the filled wire contains $CaC_2$ and the introducing step introduces between 0.1 and 2 kilograms of $CaC_2$ per ton of pig-iron.

9. The method of claim 1 wherein the contents of the axial zone are compacted.

10. The method of claim 9 wherein the contents of the axial zone had been compacted by deforming the intermediate wall to form at least one open pleat which is then closed by inwardly directed pressure to reduce the diameter of the wall without substantially elongating the wall.

11. The method of claim 1 or claim 9 wherein the contents of the annular zone are compacted.

12. The method of claim 11 wherein the contents of the axial zone had been compacted during creation of the filled wire, the compacting accomplished by deforming the outer skin to form at least one open pleat which is then closed by inwardly directed pressure to reduce the diameter of the skin without substantially elongating the skin.

13. The method of claim 1 further comprising the step of blowing an inert gas into the liquid pig-iron for between two and ten minutes.

14. The method of claim 1 further comprising a cleaning step after the introducing step to eliminate slag enriched with sulphur whereby resulphurization is avoided.

15. The method of claim 10 wherein the intermediate wall is closed by a folded seam connection.

16. The method of claim 12 wherein the outer skin is closed by a folded seam connection.

17. The method of claim 1 wherein the second material is $CaC_2$.

18. A filled wire for desulphurization of liquid pig-iron, the wire comprising:

an axial zone of compacted material surrounded by an intermediate tubular metallic wall and an annular zone of compacted material between the intermediate wall and an outer skin;

the axial zone has substantially circular cross-section and contains at least 40% magnesium in a form selected from the group of alloyed magnesium, unalloyed magnesium and mixtures thereof;

wherein the outer skin has at least one pleat closed on itself, the tip of the pleat being within the compacted material and in contact with the intermediate wall.

* * * * *